US010351803B2

(12) United States Patent
Martinez-Crowley et al.

(10) Patent No.: US 10,351,803 B2
(45) Date of Patent: Jul. 16, 2019

(54) SOLID LAUNDRY DETERGENT FOR RESTAURANT SOILS

(71) Applicant: Ecolab USA Inc., Saint Paul, MN (US)

(72) Inventors: Melissa Martinez-Crowley, Greensboro, NC (US); Jeffrey John Biggs, High Point, NC (US); Stephen Todd Smith, Greensboro, NC (US); Meghan Babcock, Minneapolis, MN (US)

(73) Assignee: Ecolab USA Inc., Saint Paul, MN (US)

( * ) Notice: Subject to any disclaimer, the term of this patent is extended or adjusted under 35 U.S.C. 154(b) by 21 days.

(21) Appl. No.: 15/012,292

(22) Filed: Feb. 1, 2016

(65) Prior Publication Data

US 2017/0218306 A1 Aug. 3, 2017

(51) Int. Cl.

| | |
|---|---|
| ***C11D 3/10*** | (2006.01) |
| ***C11D 1/83*** | (2006.01) |
| ***C11D 3/37*** | (2006.01) |
| ***C11D 3/22*** | (2006.01) |
| ***C11D 17/00*** | (2006.01) |
| *C11D 1/22* | (2006.01) |
| *C11D 3/39* | (2006.01) |
| *C11D 3/395* | (2006.01) |
| *C11D 1/72* | (2006.01) |

(52) U.S. Cl.

CPC ..... *C11D 3/10* (2013.01); *C11D 1/83* (2013.01); *C11D 3/225* (2013.01); *C11D 3/3761* (2013.01); *C11D 17/0065* (2013.01); *C11D 17/0073* (2013.01); *C11D 1/22* (2013.01); *C11D 1/72* (2013.01); *C11D 3/222* (2013.01); *C11D 3/3757* (2013.01); *C11D 3/3902* (2013.01); *C11D 3/3951* (2013.01); *C11D 17/0047* (2013.01)

(58) Field of Classification Search

CPC .... C11D 1/22; C11D 1/72; C11D 1/83; C11D 3/10; C11D 3/222; C11D 3/3757; C11D 3/3902; C11D 3/395; C11D 3/3951; C11D 17/0047; C11D 17/0065; C11D 17/0073

USPC ..... 510/445, 446, 422, 427, 470, 475, 509

See application file for complete search history.

(56) References Cited

U.S. PATENT DOCUMENTS 4,595,520 A 6/1986 Heile et al.
4,680,134 A 7/1987 Heile et al.
(Continued)

FOREIGN PATENT DOCUMENTS

WO 2003016456 A1 2/2003

OTHER PUBLICATIONS

Ecolab USA Inc., Application No. PCT/US2017/015781, filed Jan. 31, 2017, "The International Search Report and The Written Opinion of the International Searching Authority, or the Declaration" dated Apr. 27, 2017, 12 pages.

*Primary Examiner* — Gregory R Delcotto
(74) *Attorney, Agent, or Firm* — McKee, Voorhees & Sease, PLC

(57) ABSTRACT

The invention relates to solid detergents for cleaning restaurant soils and methods of making and using the same. Embodiments of the invention can include solid cleaning compositions having an alkalinity source comprising an alkali metal carbonate, a surfactant system comprising an anionic surfactant and a nonionic surfactant, a water conditioning agent, and water. Embodiments of the invention can have a pH between about 7 and about 11, and are suitable for removing restaurant soils, including, synthetic grease, animal grease, and proteinaceous soils.

17 Claims, 3 Drawing Sheets

(56) References Cited

U.S. PATENT DOCUMENTS

| | | | | |
|---|---|---|---|---|
| RE32,818 | E | 1/1989 | Fernholz et al. | |
| 5,589,099 | A | 12/1996 | Baum | |
| 5,670,473 | A | 9/1997 | Scepanski | |
| 6,124,250 | A | 9/2000 | Olson et al. | |
| 7,517,366 | B2 | 4/2009 | Evans et al. | |
| 8,753,453 | B2 | 6/2014 | Martinez-Crowley et al. | |
| 2003/0114348 | A1* | 6/2003 | Kischkel | C11D 1/721 510/446 |
| 2003/0162680 | A1* | 8/2003 | Sta | C11D 3/046 510/298 |
| 2004/0009888 | A1* | 1/2004 | Appel | C11D 10/04 510/446 |
| 2004/0014629 | A1* | 1/2004 | Lopez | C11D 17/0073 510/445 |
| 2004/0082493 | A1* | 4/2004 | Srinivas | C11D 3/323 510/446 |
| 2004/0186038 | A1* | 9/2004 | Kischkel | C11D 1/721 510/445 |
| 2010/0139705 | A1* | 6/2010 | Oberlander | C11D 3/3463 134/28 |
| 2012/0083437 | A1 | 4/2012 | Choczaj et al. | |
| 2013/0172228 | A1 | 7/2013 | Bartelme et al. | |

* cited by examiner

SOLID LAUNDRY DETERGENT FOR RESTAURANT SOILS

FIELD OF THE INVENTION

The invention relates to solid detergents for restaurant soils and methods of making and using the same. In particular, the solid detergents can be used for cleaning greasy and proteinaceous soils.

BACKGROUND OF THE INVENTION

Many cleaner compositions are presently used in many applications, such as retail, industrial and institutional applications. In many such compositions, a source of alkalinity is provided for soil removal. Additionally, in some compositions, it is also desirable to provide a source of chlorine to aid in sanitizing, bleaching, cleaning, or the like. However, it has been found that in many such compositions, the stability of the chlorine within such alkaline compositions is less than may be desired.

Further, there is a need for cleaning compositions that can adequately clean restaurant soils, which are often difficult to remove due to the high level of greasy compounds and proteinaceous soils. Compounds effective for cleaning such soils can have a pH that is too high for common staff handling and may require the use of personal protective equipment (PPE). Further, when cleaning restaurant laundry there is a risk that highly alkaline cleaning compositions will damage the laundry. Thus, there is a need to develop cleaning compositions that are effective at cleaning restaurant soils, i.e., greasy and proteinaceous soils. Additionally, there is a need for cleaning compositions that do not require the use of PPE and that will not damage restaurant laundry.

Accordingly, it is an objective of the claimed invention to develop solid cleaning compositions that are effective at cleaning restaurant soils, i.e., greasy and proteinaceous soils.

A further object of the invention is to provide cleaning compositions that do not require the use of PPE.

Another object of the invention is to provide cleaning compositions that will not damage restaurant laundry.

Still a further object of the invention is to provide solid cleaning compositions that are dimensionally stable.

Other objects, advantages and features of the present invention will become apparent from the following specification taken in conjunction with the accompanying figures.

BRIEF SUMMARY OF THE INVENTION

An advantage of the invention is the provision of solid cleaning compositions that are effective at removing greasy and proteinaceous soils. It is an advantage of the present invention that handling and use of the cleaning compositions does not require PPE. Still a further object of the present invention is that the compositions do not damage restaurant laundry.

In an embodiment, the present invention provides a solid cleaning composition having an alkalinity source comprising an alkali metal carbonate, a surfactant system comprising an anionic surfactant and a nonionic surfactant, a water conditioning agent, and water. Embodiments of the invention have a pH between about 7 and about 11 and are suitable for removing restaurant soils, including, synthetic grease, animal grease, and proteinaceous soils.

While multiple embodiments are disclosed, still other embodiments of the present invention will become apparent to those skilled in the art from the following detailed description, which shows and describes illustrative embodiments of the invention. Accordingly, the figures and detailed description are to be regarded as illustrative in nature and not restrictive.

BRIEF DESCRIPTION OF THE FIGURES

FIG. 1A compares the cleaning performance for the removal of shortening soil. FIG. 1B compares the cleaning performance for the removal of ketchup soil. FIG. 1C compares the cleaning performance for the removal of mustard soil. FIG. 1D compares the cleaning performance for the removal of kitchen grease soil.

Figure 1A:
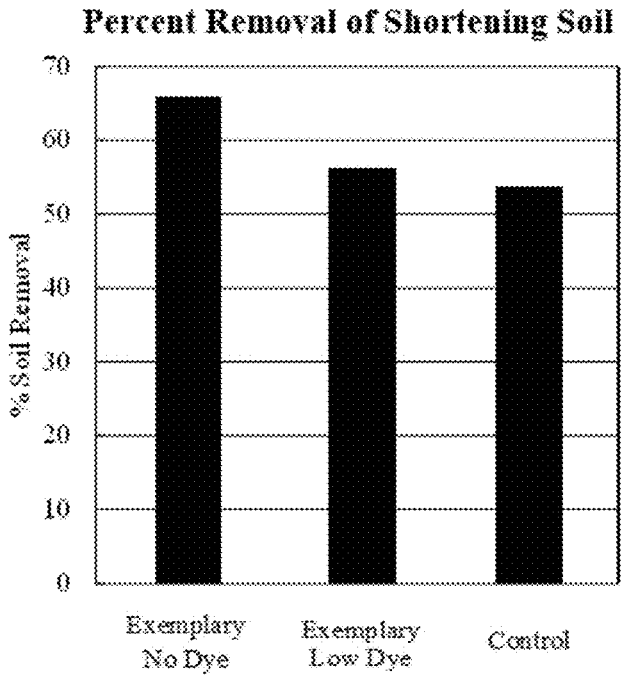
FIGS. 1A-D show the results of cleaning performance tests for an exemplary formulation of the solid cleaning compositions of the invention with and without a dye in comparison with an existing carbonate-based solid laundry detergent.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to solid cleaning compositions for cleaning restaurant soils. The cleaning compositions have many advantages over existing cleaning compositions for use in cleaning restaurant soils. For example, the cleaning compositions provide improved cleaning of greasy and proteinaceous soils, particularly when cleaning laundry. Further, the cleaning compositions do not require the use of PPE.

The embodiments of this invention are not limited to particular types of laundry to be cleaned, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

As used herein, the term "cleaning" refers to a method used to facilitate or aid in soil removal, bleaching, microbial population reduction, and any combination thereof. As used herein, the term "microbial population" refers to any non-cellular or unicellular (including colonial) organism, including all prokaryotes, bacteria (including cyanobacteria), spores, lichens, fungi, protozoa, virinos, viroids, viruses, phages, and some algae.

As used herein, the term "cleaning composition" includes, unless otherwise indicated, detergent compositions, laundry cleaning compositions, hard surface cleaning compositions, and ware wash cleaning compositions. Cleaning compositions can include both solid, paste, gel, and liquid use formulations. The cleaning compositions laundry detergent cleaning agents, laundry soak or spray treatments, fabric treatment compositions, dish washing detergents and soaps, hard surface cleaning compositions, and other similar cleaning compositions.

The term "dilutable" or any related terms as used herein, refer to a composition that is intended to be used by being diluted with water or a non-aqueous solvent by a ratio of more than 50:1.

The terms "dimensional stability" and "dimensionally stable" as used herein, refer to a solid product having a growth exponent of less than about 3%. Although not intending to be limited according to a particular theory, the polyepoxysuccinic acid or metal salt thereof is believed to control the rate of water migration for the hydration of sodium carbonate. The polyepoxysuccinic acid or metal salts thereof may stabilize the solid composition by acting as a donor and/or acceptor of free water and controlling the rate of solidification.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %.

"Soil" or "stain" refers to a non-polar oily substance which may or may not contain particulate matter such as mineral clays, sand, natural mineral matter, carbon black, graphite, kaolin, environmental dust, etc. "Restaurant soil" refers to soils that are typically found in the food service industry and include soils animal grease, synthetic greases, and proteinaceous soils.

As used herein, a solid cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the cleaning composition under the expected conditions of storage and use of the solid detergent composition. In general, it is expected that the detergent composition will remain in solid form when exposed to temperatures of up to about 100° F. and greater than about 120° F. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material. In embodiments of the invention, the solid compositions can be further diluted to prepare a use solution or added directly to a cleaning application, including, for example, a laundry machine or ware wash machine.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

As used herein the terms "use solution," "ready to use," or variations thereof refer to a composition that is diluted, for example, with water, to form a use composition having the desired components of active ingredients for cleaning. For reasons of economics, a concentrate can be marketed and an end user can dilute the concentrate with water or an aqueous diluent to a use solution.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polypropylene polymers (PP), polycarbonate polymers (PC), melamine formaldehyde resins or melamine resin (melamine), acrilonitrile-butadiene-styrene polymers (ABS), and polysulfone polymers (PS). Other exemplary plastics that can be cleaned using the compounds and compositions of the invention include polyethylene terephthalate (PET) polystyrene polyamide.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, systems, apparatuses, and compositions of the present invention may comprise, consist essentially of, or consist of the components and ingredients of the present invention as well as other ingredients described herein. As used herein, "consisting essentially of" means that the methods, systems, apparatuses and compositions may include additional steps, components or ingredients, but only if the additional steps, components or ingredients do not materially alter the basic and novel characteristics of the claimed methods, systems, apparatuses, and compositions.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and configured, constructed and arranged, adapted and configured, adapted, constructed, manufactured and arranged, and the like.

Compositions

Alkalinity Source

The solid cleaning compositions of the invention include an alkalinity source. The alkalinity source includes a carbonate-based alkalinity source. Suitable carbonates include alkali metal carbonates (including, for example, sodium carbonate and potassium carbonate), bicarbonate, sesquicarbonate, and mixtures thereof s. Use of a carbonate-based alkalinity source can assist in providing solid compositions, as the carbonate can act as a hydratable salt.

The alkalinity source can be present in amount that provides a pH greater than about 7 and up to about 11; preferably between about 8 and about 10.5, more preferably between about 8.5 and about 10. A pH that is too high can damage certain types of laundry and/or require the use of PPE. Further, use of a pH that is too low will not provide the desired cleaning efficacy and damage laundry.

Embodiments of the composition can include a secondary alkalinity source. Suitable secondary alkalinity sources can include alkanol amines, alkali metal hydroxides, alkaline metal hydroxides, silicates, and mixtures thereof. Phosphate-based alkalinity use to be common; however, it is not preferred due to environmental concerns.

Suitable alkanolamines include triethanolamine, monoethanolamine, diethanolamine, and mixtures thereof.

Suitable hydroxides include alkali and/or alkaline earth metal hydroxides. Preferably, a hydroxide-based alkalinity source is sodium hydroxide. The alkali or alkaline earth metals include such components as sodium, potassium, calcium, magnesium, barium and the like. In some embodiments of the invention, the entire method of cleaning can be substantially free of hydroxide-based alkalinity sources.

Suitable silicates include metasilicates, sesquisilicates, orthosilicates, and mixtures thereof. Preferably the silicates are alkali metal silicates. Most preferred alkali metal silicates comprise sodium or potassium.

The alkalinity source can be present in the cleaning composition in an amount of from about 65 wt. % to about 95 wt. %; preferably 70 wt. % to about 90 wt. %; and most preferably 75 wt. % to about 85 wt. %.

Defoaming Agent

The solid cleaning compositions and methods of the invention can optionally include a defoaming agent. Defoaming agents include a variety of different materials adapted for defoaming a variety of compositions. Defoaming agents can comprise an anionic or nonionic material such as polyethylene glycol, polypropylene glycol, fatty acids and fatty acid derivatives, fatty acid sulfates, phosphate esters, sulfonated materials, silicone based compositions, and others.

Preferred silicone defoaming agents can include a polydialkylsiloxane, such as polydimethylsiloxane, or a silicone emulsion such as silicone emulsion. In some embodiments, silicone based defoaming agents can be combined with silica, including, for example silica, fumed silica, derivatized silica, and silanated silica.

Preferred fatty acid defoaming agents can comprise simple alkali metal or alkaline earth metal salts of a fatty acid or fatty acid derivatives. Examples of such derivatives include mono, di- and tri-fatty acid esters of polyhydroxy compounds such as ethylene glycol, glycerine, propylene glycol, hexylene glycol, etc. Preferably such defoaming agents comprise a fatty acid monoester of glycerol. Fatty acids useful in such defoaming compositions can include any $C_{8-24}$ saturated or unsaturated, branched or unbranched mono or polymeric fatty acid and salts thereof, including for example myristic acid, palmitic acid, stearic acid, behenic acid, lignoceric acid, palmitoleic acid, oleic acid, linoleic acid, arachidonic acid, and others commonly available.

Other suitable defoaming agents include water insoluble waxes, preferably microcrystalline wax, petroleum wax, synthetic petroleum wax, rice base wax, beeswax having a melting point in the range from about 35° C. to 125° C. with a low saponification value, white oils, etc.

When a defoaming agent is added it can be added in an amount suitable to reduce foam to the desired amount. Thus, the amount of defoaming agent added can depend on the other ingredients in the formulation. It is expected that it in certain embodiments of the invention, a suitable amount of defoaming agent is between about 0.0001 wt. % and about 5 wt. %, more preferably between about 0.0005 wt. % and about 2 wt. %, most preferably between 0.001 wt. % and about 0.5 wt. %.

Enzyme

The solid cleaning compositions and methods of the invention can optionally include an enzyme. Enzymes can aid in the removal of soils, including in particular proteinaceous and starchy soils. Selection of an enzyme is influenced by factors such as pH-activity and/or stability optima, thermostability, and stability with the active ingredients, e.g., alkalinity source and surfactants.

Protease enzymes are particularly advantageous for cleaning soils containing protein, such as blood, cutaneous scales, mucus, grass, food (e.g., egg, milk, spinach, meat residue, tomato sauce), or the like. Additionally, proteases have the ability to retain their activity at elevated temperatures. Protease enzymes are capable of cleaving macromolecular protein links of amino acid residues and convert substrates into small fragments that are readily dissolved or dispersed into the aqueous use solution. Proteases are often referred to as detersive enzymes due to the ability to break soils through the chemical reaction known as hydrolysis. Protease enzymes can be obtained, for example, from *Bacillus subtilis, Bacillus licheniformis* and *Streptomyces griseus*. Protease enzymes are also commercially available as serine endoproteases.

Examples of commercially-available protease enzymes are available under the following trade names: Esperase, Purafect, Purafect L, Purafect Ox, Everlase, Liquanase, Savinase, Prime L, Prosperase and Blap.

The enzyme compositions according to the invention may be an independent entity and/or may be formulated in combination with the detergent compositions. According to an embodiment of the invention, an enzyme composition may be formulated into the detergent compositions in either liquid or solid formulations. In addition, enzyme compositions may be formulated into various delayed or controlled release formulations. For example, a solid molded detergent composition may be prepared without the addition of heat. As a skilled artisan will appreciate, enzymes tend to become denatured by the application of heat and therefore use of enzymes within detergent compositions require methods of forming a detergent compositions that does not rely upon heat as a step in the formation process, such as solidification. Enzymes can improve cleaning in cold water wash conditions. Further, cold water wash conditions can ensure the enzymes are not thermally denatured.

The enzyme composition may further be obtained commercially in a solid (i.e., puck, powder, etc.) or liquid formulation. Commercially-available enzymes are generally combined with stabilizers, buffers, cofactors and inert vehicles. The actual active enzyme content depends upon the method of manufacture, which is well known to a skilled artisan and such methods of manufacture are not critical to the present invention.

Alternatively, the enzyme composition may be provided separate from the detergent composition, such as added directly to the wash liquour or wash water of a particular application of use, e.g., laundry machine or dishwasher.

Additional description of enzyme compositions suitable for use according to the invention is disclosed for example in U.S. Pat. Nos. 7,670,549, 7,723,281, 7,670,549, 7,553,806, 7,491,362, 6,638,902, 6,624,132, and 6,197,739 and U.S. Patent Publication Nos. 2012/0046211 and 2004/0072714, each of which are herein incorporated by reference in its entirety. In addition, the reference "Industrial Enzymes", Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980 is incorporated herein in its entirety.

Enzyme Stabilizing Agents

The solid cleaning compositions and methods of the invention can optionally include enzyme stabilizers (or stabilizing agent(s)) which may be dispensed manually or automatically into a use solution of the solid cleaning composition and/or enzyme composition. In the alternative, a stabilizing agent and enzyme may be formulated directly into the solid cleaning compositions according to the invention. The formulations of the solid cleaning compositions and/or the enzyme composition may vary based upon the particular enzymes and/or stabilizing agents employed.

In an aspect, the stabilizing agent is a starch, poly sugar, amine, amide, polyamide, or poly amine. In still further aspects, the stabilizing agent may be a combination of any of the aforementioned stabilizing agents. In an embodiment, the stabilizing agent may include a starch and optionally an additional food soil component (e.g., fat and/or protein). In an aspect, the stabilizing agent is a poly sugar. Beneficially, poly sugars are biodegradable and often classified as Generally Recognized As Safe (GRAS). Exemplary poly sugars include, but are not limited to: amylose, amylopectin, pectin, inulin, modified inulin, potato starch, modified potato starch, corn starch, modified corn starch, wheat starch, modified wheat starch, rice starch, modified rice starch, cellulose, modified cellulose, dextrin, dextran, maltodextrin, cyclodextrin, glycogen, oligiofructose and other soluble starches. Particularly suitable poly sugars include, but are not limited to: inulin, carboxymethyl inulin, potato starch, sodium carboxymethylcellulose, linear sulfonated alpha-(1,4)-linked D-glucose polymers, gamma-cyclodextrin and the like. Combinations of poly sugars may also be used according to embodiments of the invention.

The stabilizing agent according to the invention may be an independent entity and/or may be formulated in combination with the detergent composition and/or enzyme composition. According to an embodiment of the invention, a stabilizing agent may be formulated into the detergent composition (with or without the enzyme) in either liquid or solid formulations. In addition, stabilizing agent compositions may be formulated into various delayed or controlled release formulations. For example, a solid molded detergent composition may be prepared without the addition of heat. Alternatively, the stabilizing agent may be provided separate from the detergent and/or enzyme composition, such as added directly to the wash liquour or wash water of a particular application of use, e.g. dishwasher.

Polymer

The solid cleaning compositions and methods of the invention can optionally include a polymer. A polymer can be beneficial to serve as a binder, improve performance, and inhibit crystal growth thereby preventing precipitation of carbonates. When a polymer is included in the solid cleaning compositions, it can be in an amount of about 0.05 wt. % to about 5 wt. %; preferably between about 0.1 wt. % and about 3.5 wt. %, most preferably between about 0.5 wt. % and about 2.5 wt. %.

Suitable polymers include, but are not limited to high molecular weight polyacrylates (or polyacrylic acid homopolymers). Suitable high molecular weight polyacrylates can have a molecular weight of at least about 5000. The high molecular weight polyacrylates can contain a polymerization unit derived from the monomer selected from the group consisting of acrylic acid, methacrylic acid, methyl acrylate, methyl methacrylate, ethyl acrylate, ethyl methacrylate, butyl acrylate, butyl methacrylate, iso-butyl acrylate, iso-butyl methacrylate, iso-octyl acrylate, iso-octyl methacrylate, cyclohexyl acrylate, cyclohexyl methacrylate, glycidyl acrylate, glycidyl methacrylate, hydroxyethyl acrylate, hydroxypropyl acrylate, 2-hydroxyethyl acrylate, 2-hydroxyethyl methacrylate, 2-hydroxypropyl acrylate, 2-hydroxypropyl methacrylate and hydroxypropyl methacrylate and a mixture thereof, among which acrylic acid. Methacrylic acid, methyl acrylate, methyl methacrylate, butyl acrylate, butyl methacrylate, iso-butyl acrylate, iso-butyl methacrylate, hydroxyethyl acrylate, 2-hydroxyethyl acrylate, 2-hydroxyethyl methacrylate, 2-hydroxypropyl acrylate, and 2-hydroxypropyl methacrylate, and a mixture thereof are preferred.

The above-mentioned acrylate monomers can be selected from the group consisting of methyl acrylate, methyl methacrylate, butyl acrylate, 2-phenoxy ethyl acrylate, ethoxylated 2-phenoxy ethyl acrylate, 2-(2-ethoxyethoxy)ethyl acrylate, cyclic trimethylolpropane formal acrylate, β-carboxyethyl acrylate, lauryl(meth)acrylate, isooctyl acrylate, stearyl(meth)acrylate, isodecyl acrylate, isoborny(meth) acrylate, benzyl acrylate, hydroxypivalyl hydroxypivalate diacrylate, ethoxylated 1,6-hexanediol diacrylate, dipropylene glycol diacrylate, ethoxylated dipropylene glycol diacrylate, neopentyl glycol diacrylate, propoxylated neopentyl glycol diacrylate, ethoxylated bisphenol-A di(meth)acrylate, 2-methyl-1,3-propanediol diacrylate, ethoxylated 2-methyl-1,3-propanediol diacrylate, 2-butyl-2-ethyl-1,3-propanediol diacrylate, ethylene glycol dimethacrylate, diethylene glycol dimethacrylate, 2-hydroxyethyl methacrylate phosphate, tris (2-hydroxy ethyl)isocyanurate triacrylate, pentaerythritol triacrylate, ethoxylated trimethylolpropane triacrylate, propoxylated trimethylolpropane triacrylate, trimethylolpropane trimethacrylate, pentaerythritol tetraacrylate, ethoxylated pentaerythritol tetraacrylate, ditrimethylolpropane tetraacrylate, propoxylated pentaerythritol tetraacrylate, pentaerythritol tetraacrylate, dipentaerythritol hexaacrylate, (meth)acrylate, hydroxyethyl acrylate (HEA), 2-hydroxyethyl methacrylate (HEMA), tripropylene glycol di(meth) acrylate-1,4-butanediol di(meth)acrylate, 1,6-hexanediol di(meth)acrylate, allylated cyclohexyl di(meth)acrylate, isocyanurate di(meth)acrylate, ethoxylated trimethylol propane tri(meth)acrylate, propoxylated glycerol tri(meth)acrylate, trimethylol propane tri(meth)acrylate, and tris(acryloxyethyl)isocyanurate, and a mixture thereof.

Preferred are polyacrylic acids, $(C_3H_4O_2)_n$ or 2-Propenoic acid homopolyimers Acrylic acid polymer; Poly(acrylic acid); Propenoic acid polymer PAA have the following structural formula:

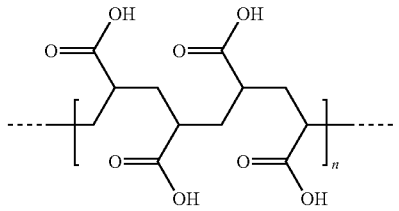

where n is any integer.

One source of commercially available polyacrylates (polyacrylic acid homopolymers) useful for the invention includes the Acusol 445 series from The Dow Chemical Company, Wilmington Del., USA, including, for example, Acusol® 445 (acrylic acid polymer, 48% total solids) (4500 MW), Acusol® 445N (sodium acrylate homopolymer, 45% total solids) (4500 MW), and Acusol® 445ND (powdered sodium acrylate homopolymer, 93% total solids) (4500 MW) Other polyacrylates (polyacrylic acid homopolymers) commercially available from Dow Chemical Company suitable for the invention include, but are not limited to Acusol 929 (10,000 MW) and Acumer 1510. Yet another example of a commercially available polyacrylic acid is AQUATREAT AR-6 (100,000 MW) from AkzoNobel Strawinskylaan 2555 1077 ZZ Amsterdam Postbus 75730 1070 AS Amsterdam. Other suitable polyacrylates (polyacrylic acid homopolymers) for use in the invention include, but are not limited to those obtained from additional suppliers such as Aldrich Chemicals, Milwaukee, Wis., and ACROS Organics and Fine Chemicals, Pittsburgh, Pa., BASF Corporation and SNF Inc.

Silicate

The solid cleaning compositions and methods of the invention can optionally include a silicate as a metal protectant. A benefit of using a silicate as a metal protectant is that it can also serve as a secondary alkalinity source. In some embodiments, this may be beneficial. An effective amount of an alkaline metal silicate or hydrate thereof can be employed in the compositions and processes of the invention to form a stable solid cleaning compositions that can have metal protecting capacity.

Suitable silicates include, but are not limited to, alkali metal silicates are those powdered, particulate or granular silicates which are either anhydrous or preferably which contain water of hydration (5 to 25 wt. %, preferably 15 to 20 wt. % water of hydration). These silicates are preferably sodium silicates and have a $Na_2O:SiO_2$ ratio of about 1:1 to about 1:5, respectively, and typically contain available bound water in the amount of from 5 to about 25 wt. %. In general, the silicates have a $Na_2O:SiO_2$ ratio of 1:1 to about 1:3.75, preferably about 1:1.5 to about 1:3.75 and most preferably about 1:1.5 to about 1:2.5. A silicate with a $Na_2O:SiO_2$ ratio of about 1:2 and about 16 to 22 wt % water of hydration, is most preferred. For example, such silicates are available in powder form as GD Silicate and in granular form as Britesil H-20, from PQ Corporation. These ratios may be obtained with single silicate compositions or combinations of silicates which upon combination result in the preferred ratio. The hydrated silicates at preferred ratios, a $Na_2O:SiO_2$ ratio of about 1:1.5 to about 1:2.5 have been found to provide the optimum metal protection and rapidly forming solid block detergent. The amount of silicate used in forming the compositions of the invention tend to vary between about 10 wt. % and about 30 wt. %, preferably about 15 wt. % to 30 wt. % depending on degree of hydration. Hydrated silicates are preferred.

Surfactants

The solid cleaning compositions of the present invention include a surfactant. Surfactants suitable for use with the compositions of the present invention include, but are not limited to, nonionic surfactants and anionic surfactants. In some embodiments of the invention, the cleaning compositions are substantially free of cationic surfactants. Surfactants can be added to the cleaning compositions in an amount between about 1 wt. % and about 25 wt. %; preferably between about 5 wt. % and about 20 wt. %; and most preferably between about 7 wt. % and about 15 wt. %.

In a preferred embodiment, the solid cleaning compositions include a surfactant system comprised of at least two surfactants, more preferably, at least three surfactants. The surfactant system preferably includes both a nonionic surfactant and an anionic surfactant. In still a more preferred embodiment, the surfactant system comprises an anionic surfactant and at least two nonionic surfactants.

Nonionic Surfactants

Nonionic surfactants can be added in an amount between about 1 wt. % and about 13 wt. %; more preferably between about 2 wt. % and about 10 wt. %; and most preferably between about 3.5 wt. % and about 8.5 wt. %

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Utensil™, Dehydol™ manufactured by BASF, Neodol™ manufactured by Shell Chemical Co. and Alfonic™ manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

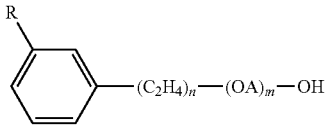

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_{60})_n(C_2H_{40})_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms, more preferably between 10 and 18 carbon atoms, most preferably between 12 and 16 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan.

21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}—(PO)_sN\text{-}(EO)_tH$, $R^{20}—(PO)_sN\text{-}(EO)_tH(EO)_tH$, and $R^{20}—N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}—(PO)_v—N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Preferred nonionic surfactants include alcohol ethoxylates and linear alcohol ethoxylates.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. Anionic surfactants can be added in an amount between about 1 wt. % and about 10 wt. %; more preferably between about 2 wt. % and about 8.5 wt. %; and most preferably between about 3 wt. % and about 7 wt. %.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

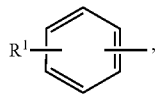

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

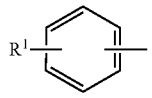

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Water

The solid cleaning compositions of the invention can include water. Water may be independently added to the cleaning composition or may be provided in the solid cleaning composition as a result of its presence in an aqueous material that is added to the solid cleaning composition. For example, materials added to the solid cleaning composition include water or may be prepared in an aqueous premix available for reaction with the solidification agent component(s). Typically, water is introduced into the solid cleaning composition to provide the composition with a desired powder flow characteristics prior to solidification, and to provide a desired rate of solidification.

In general, it is expected that water may be present as a processing aid and may be removed or become water of hydration. It is expected that water may be present in the solid cleaning composition. It is expected that the water will be present in the solid cleaning composition in the range of between 0 wt. % and 15 wt. %. The amount of water can be influenced by the ingredients in the particular formulation and by the type of solid the cleaning composition is formulated into. For example, in pressed solids, the water may be between 2 wt. % and about 10 wt. %, preferably between about 4 wt. % and about 8 wt. %. In embodiments, the water may be provided as deionized water or as softened water.

The components used to form the solid cleaning composition can include water as hydrates or hydrated forms of the binding agent, hydrates or hydrated forms of any of the other ingredients, and/or added aqueous medium as an aid in processing. It is expected that the aqueous medium will help provide the components with a desired viscosity for processing. In addition, it is expected that the aqueous medium may help in the solidification process when is desired to form the concentrate as a solid.

Water Conditioning Agent

The solid cleaning compositions and methods of the invention can optionally include a water conditioning agent. Water conditioning agents aid in removing metal compounds and in reducing harmful effects of hardness components in service water. Exemplary water conditioning agents include antiredeposition agents, chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces and can reduce or eliminate the inappropriate interaction with active ingredients including the nonionic surfactants and anionic surfactants of the invention. Both organic and inorganic water conditioning agents can be used in the solid cleaning compositions of the invention.

Suitable organic water conditioning agents can include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. More recently the use of sodium carboxymethyl cellulose as an antiredeposition agent was discovered. This is discussed more extensively in U.S. Pat. No. 8,729,006 to Miralles et al., which is incorporated herein in its entirety.

Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

Suitable inorganic water conditioning agents include, but are not limited to, sodium tripolyphosphate and other higher linear and cyclic polyphosphates species.

When included in the solid cleaning compositions of the invention, the water conditioning agents can be in an amount from about 0.05 wt. % to about 7 wt. %; preferably from about 0.1 wt. % to about 5 wt. %; and more preferably from about 0.5 wt. % to about 3 wt. %.

Whitening Agent/Bleaching Agent

The solid cleaning compositions and methods of the invention can optionally include a whitening or bleaching agent. Suitable whitening agents include halogen-based bleaching agents and oxygen-based bleaching agents. The whitening agent can be added to the solid cleaning compositions; however, in some embodiments of the invention, the whitening agent can be used in the pre-soak or pre-treatment step so that the later laundering step may be free of bleaching agents. This can be beneficial in formulating solid detergent compositions as there can be difficulties in formulating solid compositions with bleaching agents.

If no enzyme material is present in the compositions, a halogen-based bleach may be effectively used as ingredient of the first component. In that case, said bleach is desirably present at a concentration (as active halogen) in the range of from 0.1 to 10%, preferably from 0.5 to 8%, more preferably from 1 to 6%, by weight. As halogen bleach, alkali metal hypochlorite may be used. Other suitable halogen bleaches are alkali metal salts of di- and tri-chloro and di- and tri-bromo cyanuric acids. Preferred halogen-based bleaches comprise chlorine.

Some examples of classes of compounds that can act as sources of chlorine include a hypochlorite, a chlorinated phosphate, a chlorinated isocyanurate, a chlorinated melamine, a chlorinated amide, and the like, or mixtures of combinations thereof.

Some specific examples of sources of chlorine can include sodium hypochlorite, potassium hypochlorite, calcium hypochlorite, lithium hypochlorite, chlorinated tri sodium-phosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof, or combinations or mixtures thereof.

Suitable oxygen-based bleaches include peroxygen bleaches, such as sodium perborate (tetra- or monohydrate), sodium percarbonate or hydrogen peroxide. These are preferably used in conjunction with a bleach activator which allows the liberation of active oxygen species at a lower temperature. Numerous examples of activators of this type, often also referred to as bleach precursors, are known in the art and amply described in the literature such as U.S. Pat. Nos. 3,332,882 and 4,128,494 herein incorporated by reference. Preferred bleach activators are tetraacetyl ethylene diamine (TAED), sodium nonanoyloxybenzene sulphonate (SNOBS), glucose pentaacetate (GPA), tetraacetylmethylene diamine (TAMD), triacetyl cyanurate, sodium sulphonyl ethyl carbonic acid ester, sodium acetyloxybenzene and the mono long-chain acyl tetraacetyl glucoses as disclosed in WO-91/10719, but other activators, such as choline sulphophenyl carbonate (CSPC), as disclosed in U.S. Pat. Nos. 4,751,015 and 4,818,426 can also be used.

Peroxybenzoic acid precursors are known in the art as described in GB-A-836,988, herein incorporated by reference. Examples of suitable precursors are phenylbenzoate, phenyl p-nitrobenzoate, o-nitrophenyl benzoate, o-carboxyphenyl benzoate, p-bromophenyl benzoate, sodium or potassium benzoyloxy benzene sulfonate and benzoic anhydride.

Preferred peroxygen bleach precursors are sodium p-benzoyloxy-benzene sulfonate, N,N,N,N-tetraacetyl ethylene diamine (TEAD), sodium nonanoyloxybenzene sulfonate (SNOBS) and choline sulfophenyl carbonate (CSPC).

The whitening agent can be present in an amount of from about 0% by weight to about 10% by weight, preferably 0% by weight to about 8% by weight and more preferably from about 0% by weight to about 5% by weight.

Additional Functional Ingredients

The solid cleaning compositions and methods of invention can optionally include additional functional ingredients to impart desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. Functional ingredients that can be added to the solid cleaning compositions can include, but are not limited to, dyes and fragrances. When added to the solid cleaning compositions of the invention, dyes and/or fragrances can be added in an amount between about 0.005 and about 0.5 wt. %. In embodiments including a dye, it is preferable that the solid cleaning compositions retain the color, i.e., that the color does not change or fade.

Embodiments

The compositions of the invention can be formulated and prepared as any type of solid, e.g., extruded, cast, pressed, or granulated. A solid may be in various forms such as a powder, a flake, a granule, a pellet, a tablet, a lozenge, a puck, a briquette, a brick, a solid block, a unit dose, or another solid form known to those of skill in the art. Preferably the compositions are prepared as pressed solids. Exemplary ranges of solid cleaning compositions according to an exemplary solid embodiments are shown in Table 1.

TABLE 1

| Material | First Exemplary Range wt-% | Second Exemplary Range wt-% | Third Exemplary Range wt-% |
|---|---|---|---|
| Alkalinity Source | 65-95 | 70-90 | 75-85 |
| Defoaming Agent | 0.0001-5 | 0.0005-2 | 0.001-0.5 |
| Polymer | 0.05-5 | 0.1-3.5 | 0.5-2.5 |
| Surfactant System | 1-25 | 5-20 | 7-15 |
| Water | 0-15 | 2-10 | 4-8 |
| Water Conditioning Agent | 0.05-7 | 0.1-5 | 0.5-3 |
| Whitening Agent | 0-10 | 0-8 | 0-5 |
| Additional Functional Ingredients | 0-25 | 0-20 | 0-10 |

In a pressed solid process, a flowable solid, such as granular solids or other particle solids are combined under pressure. In a pressed solid process, flowable solids of the compositions are placed into a form (e.g., a mold or container). The method can include gently pressing the flowable solid in the form to produce the solid cleaning composition. Pressure may be applied by a block machine or a turntable press, or the like. Pressure may be applied at about 1 to about 2000 psi, about 1 to about 300 psi, about 5 psi to about 200 psi, or about 10 psi to about 100 psi. In certain embodiments, the methods can employ pressures as low as greater than or equal to about 1 psi, greater than or equal to about 2, greater than or equal to about 5 psi, or greater than or equal to about 10 psi. As used herein, the term "psi" or "pounds per square inch" refers to the actual pressure applied to the flowable solid being pressed and does not refer to the gauge or hydraulic pressure measured at a point in the apparatus doing the pressing. The method can include a curing step to produce the solid cleaning composition. As referred to herein, an uncured composition including the flowable solid is compressed to provide sufficient surface contact between particles making up the flowable solid that the uncured composition will solidify into a stable solid cleaning composition. A sufficient quantity of particles (e.g. granules) in contact with one another provides binding of particles to one another effective for making a stable solid composition. Inclusion of a curing step may include allowing the pressed solid to solidify for a period of time, such as a few hours, or about 1 day (or longer). In additional aspects, the methods could include vibrating the flowable solid in the form or mold, such as the methods disclosed in U.S. Pat. No. 8,889,048, which is herein incorporated by reference in its entirety.

The use of pressed solids provide numerous benefits over conventional solid block or tablet compositions requiring high pressure in a tablet press, or casting requiring the melting of a composition consuming significant amounts of energy, and/or by extrusion requiring expensive equipment and advanced technical know-how. Pressed solids overcome such various limitations of other solid formulations for which there is a need for making solid cleaning compositions. Moreover, pressed solid compositions retain its shape under conditions in which the composition may be stored or handled.

The degree of hardness of the solid cast composition and/or a pressed solid composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly up to approximately 120° F.

The solid cleaning compositions can be used as concentrated solid compositions or may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the invention. It should be understood that the concentration of the ingredients in the detergent composition will vary depending on whether the detergent composition is provided as a concentrate or as a use solution.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water.

In an aspect of the invention, the detergent composition preferably provides efficacious cleaning at low use dilutions, i.e., require less volume to clean effectively. In an aspect, a concentrated liquid detergent composition may be diluted in water prior to use at dilutions ranging from about 1/16 oz./gal. to about 2 oz./gal. or more. A detergent concentrate that requires less volume to achieve the same or better cleaning efficacy and provides hardness scale control and/or other benefits at low use dilutions is desirable.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1—Performance Assessment

Exemplary solid cleaning compositions of the invention were prepared as a pressed solid. The formulation is described in Table 2. One sample contained dye as expressed in Table 2, the other sample had no dye, but otherwise was the same as described in Table 2. Those exemplary solid cleaning compositions are identified in FIGS. 1A-1D as "Exemplary Low Dye" and "Exemplary No Dye." The exemplary solid cleaning compositions were compared to a commercially available pressed solid control formulation, which is described in Table 3 and shown in FIGS. 1A-1D as Control.

TABLE 2

| Ingredient | Weight Percentage |
|---|---|
| Sodium Carbonate (High Density Granular) | 81.7065 |
| Alcohol Ethoxylate | 2.4 |
| Linear C12-C16 Alcohol Ethoxylate (7 Mole EO) | 3.6 |
| Acusol 445ND | 1 |
| Silicone Emulsion DRM | 0.001 |
| Linear Alkyl Benzene Sulfonate | 5.4 |
| Sodium Carboxymethyl Cellulose | 0.63 |
| Water (Soft) | 5 |
| Fragrance | 0.25 |
| Dye | 0.0125 |

TABLE 3

| Ingredient | Weight Percentage |
|---|---|
| Light Ash (carbonate) | 88.3 |
| Linear Alkyl Benzene Sulfonate | 5.4 |
| Linear C12-C16 Alcohol Ethoxylate (7 Mole EO) | 3.6 |
| Alcohol Ethoxylate | 2.4 |
| Silicone Emulsion | 0.001 |
| Fragrance | 0.25 |
| Dye | 0.05 |

Swatches were soiled with shortening, ketchup, mustard, and kitchen grease. Stain removal was evaluated according to detergency testing methods using a tergotometer. The tergotometer contains six pots filled with 1 L of water sitting in a temperature controlled water bath. A HunterLab Color Quest spectrophotometer was used to determine the lightness or darkness of each swatch, as measured by the L* value, prior to washing. Each of the detergent compositions was prepared as a use solution and the soiled swatches were washed in the use solutions for an equal amount of time. After completion of that time the swatches were removed the use solutions, rinsed with cold water, and squeezed to remove the excess water from the swatches. The rinse and squeeze process was repeated two more times and then the swatches were dried. After drying, the swatches were again read on the spectrophotometer to determine the post-wash L* value. The % stain removal is calculated from the difference between the initial (before washing) L* value and the final L* value (after washing).

Figure 1B:
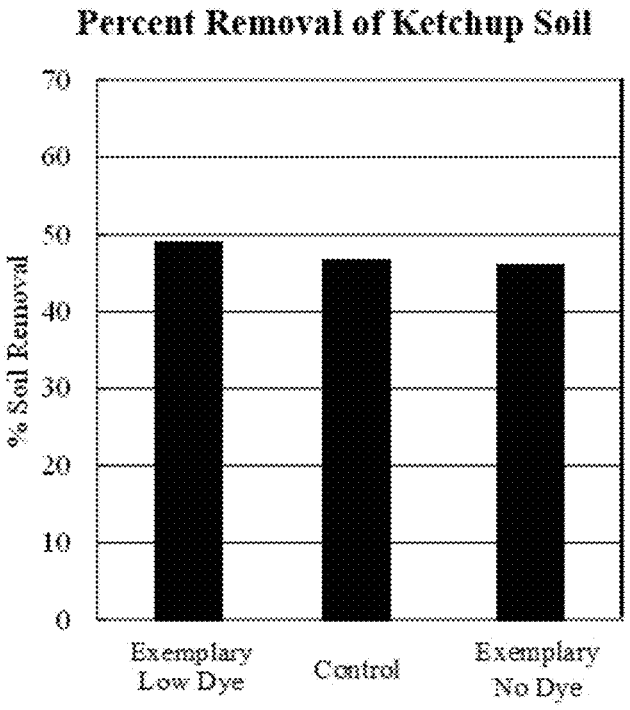
Figure 1C:
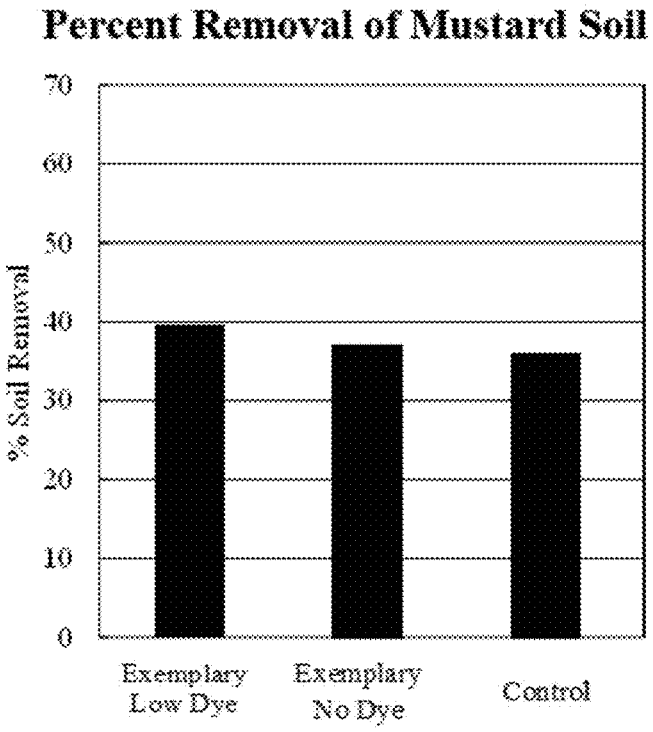
Figure 1D:
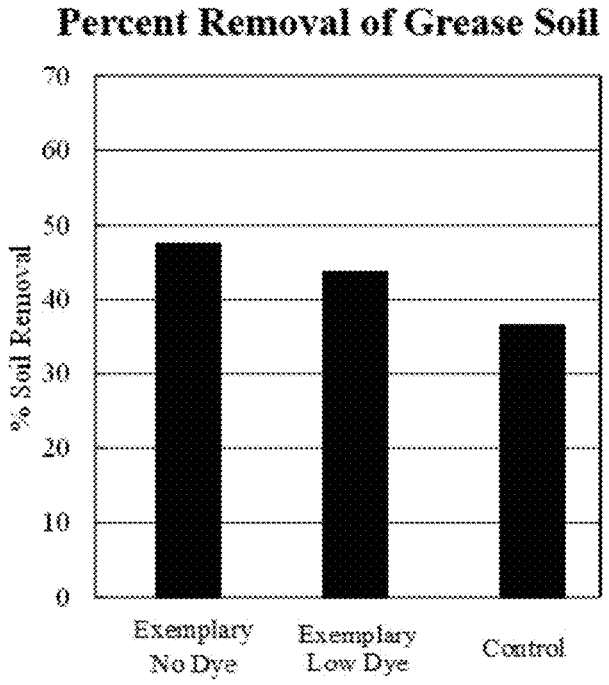

The results of the percent soil removal study are shown in FIGS. 1A-1D. FIG. 1A shows the percent soil removal of shortening soil. FIG. 1B shows the percent soil removal of ketchup soil. FIG. 1C shows the percent soil removal of mustard soil. FIG. 1D shows the percent soil removal of kitchen grease soil. As can be seen from the figures, both of the exemplary solid cleaning compositions performed better than the control with respect to all four stains, with the exception of the ketchup soil where the control and exemplary formulation exhibited substantially similar cleaning. The exemplary formula with low dye did outperform control and exemplary formulation with no dye in removing the ketchup soil.

Example 2—Dimensional Stability Study

Figure 2:
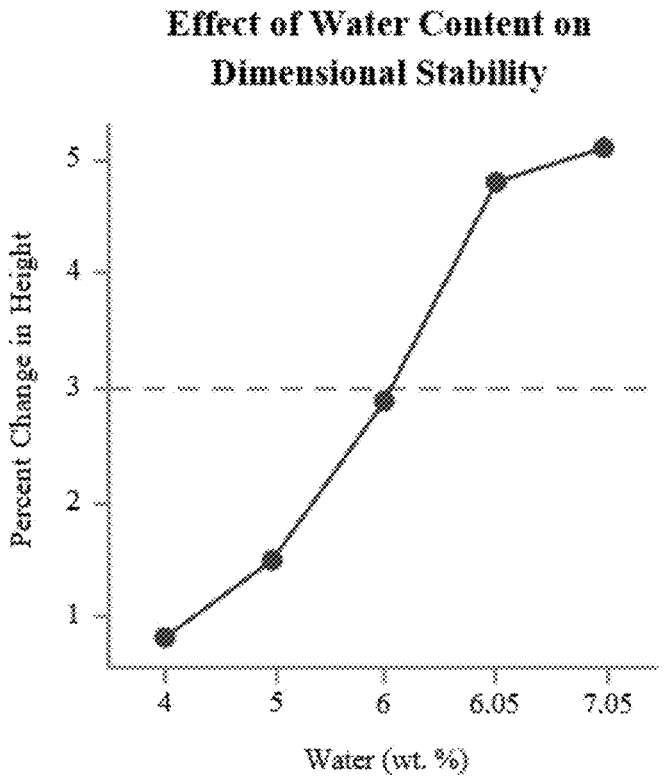
FIG. 2 is graph showing the effect of water content on the dimensional stability of an exemplary solid cleaning composition of the invention prepared as a pressed solid.

The effect of the amount of water on the dimensional stability for pressed solid formulations of exemplary solid cleaning compositions was studied. Exemplary formulations of the invention were prepared with 4 wt. %, 5 wt. %, 6 wt. %, 6.05 wt. %, and 7.05 wt. % water, and formed into pressed solids. The initial height of the cleaning compositions was measured. The compositions were stored for six weeks at 120° F. At the conclusion of the six weeks, the height of the cleaning compositions was measured again. The percent increase in height was calculated to determine the amount of swelling as related to the water content in the compositions. The results are shown in FIG. 2. Compositions having a growth of less than three percent are considered to be dimensionally stable. As can be seen in FIG. 2, the compositions having 6 wt. % water or less provided such dimensional stability; however, the compositions having more than 6 wt. % water both exceeded the three percent growth limit.

The inventions being thus described, it will be obvious that the same may be varied in many ways. Such variations are not to be regarded as a departure from the spirit and scope of the inventions and all such modifications are intended to be included within the scope of the following claims.

The above specification provides a description of the manufacture and use of the disclosed compositions and methods. Since many embodiments can be made without departing from the spirit and scope of the invention, the invention resides in the claims.

What is claimed is:

1. A pressed solid cleaning composition comprising:

between about 65 wt. % and about 95 wt. % of an alkalinity source comprising an alkali metal carbonate;

between about 1 wt. % and about 25 wt. % of a surfactant system comprising a nonionic surfactant, wherein the nonionic surfactant comprises a C10-C18 linear alcohol ethoxylate, an alcohol ethoxylate, or combinations thereof; and an anionic surfactant, wherein the anionic surfactant comprises a linear alkyl benzene sulfonate;

between about 0.05 wt. % and about 7 wt. % of a water conditioning agent, wherein the water conditioning agent comprises an antiredeposition agent, chelating agent, sequestering agent, inhibitor, or combinations thereof;

between about 2 wt. % and 6 wt. % of water; and wherein the composition has a pH greater than about 7 and up to about 11; wherein the composition does not contain a halogen-based whitening agent; and wherein the composition can remove synthetic grease, animal grease, and proteinaceous soils.

2. The composition of claim 1, further comprising a polymer in an amount between about 0.05 wt. % and about 5 wt. %.

3. The composition of claim 1, wherein the nonionic surfactant is present in an amount between about 1 wt. % and about 13 wt. %.

4. The composition of claim 1, wherein the anionic surfactant is present in an amount between about 1 wt. % and about 10 wt. %.

5. The composition of claim 2, wherein the polymer is a polyacrylate, and wherein the water conditioning agent comprises sodium carboxymethyl cellulose.

6. The composition of claim 1 further comprising a dye, an enzyme, a fragrance, a whitening agent which is an oxygen-based bleaching agent, or combinations thereof.

7. A pressed solid cleaning composition comprising:

between about 65 wt. % and about 95 wt. % of an alkalinity source comprising an alkali metal carbonate;

between about 0.05 wt. % and about 5 wt. % of a polymer;

between about 1 wt. % and about 25 wt. % of a surfactant system comprising a nonionic surfactant, wherein the nonionic surfactant comprises a C10-C18 linear alcohol ethoxylate, an alcohol ethoxylate, or combinations thereof; and an anionic surfactant, wherein the anionic surfactant comprises a linear alkyl benzene sulfonate;

between about 0.05 wt. % and about 7 wt. % of a water conditioning agent, wherein the water conditioning agent comprises an antiredeposition agent, chelating agent, sequestering agent, inhibitor, or combinations thereof;

between about 2 wt. % and 6 wt. % of water; and wherein the composition has a pH greater than about 7 and up to about 11; wherein the composition does not contain a halogen-based whitening agent; and wherein the composition can remove synthetic grease, animal grease, and proteinaceous soils.

8. The composition of claim 7, wherein the nonionic surfactant is present in an amount between about 1 wt. % and about 13 wt. %, and comprises a C10-C18 linear alcohol ethoxylate having between 2 and 20 moles of ethylene oxide, an alcohol ethoxylate, or combinations thereof.

9. The composition of claim 7, wherein the anionic surfactant is present in an amount between about 1 wt. % and about 10 wt. % and comprises a linear alkyl benzene sulfonate; and wherein the polymer is a polyacrylate, and wherein the water conditioning agent comprises sodium carboxymethyl cellulose.

10. The composition of claim 7 further comprising a dye, an enzyme, a fragrance, a whitening agent which is an oxygen-based bleaching agent, or combinations thereof.

11. The composition of claim 10, wherein the whitening agent is a peroxygen bleach.

12. The composition of claim 7, wherein the composition is diluted with water to form a use solution.

13. A method of cleaning laundry comprising:

contacting laundry with a cleaning composition of claim 7, wherein the laundry is soiled with a restaurant soil; and rinsing the laundry.

14. The method of claim 13 further comprising contacting the laundry with a whitening agent which is an oxygen-based bleaching agent.

15. The method of claim 14, wherein the whitening agent is a pretreatment or an ingredient in the cleaning composition.

16. The method of claim 13, wherein the nonionic surfactant is present in an amount between about 1 wt. % and about 13 wt. %, and comprises a C10-C18 linear alcohol ethoxylate having between 2 and 20 moles of ethylene oxide, an alcohol ethoxylate, or combinations thereof; and wherein the anionic surfactant is present in an amount between about 1 wt. % and about 10 wt. % and comprises a linear alkyl benzene sulfonate.

17. The method of claim 13, wherein the cleaning composition further comprises a dye, an enzyme, a fragrance, a whitening agent which is an oxygen-based bleaching agent, or combinations thereof.

* * * * *